US005894604A

United States Patent [19]

Crabb et al.

[11] Patent Number: 5,894,604

[45] Date of Patent: Apr. 20, 1999

[54] MULTI-USE CAP WITH ACCESSORIES POCKET

[75] Inventors: Stephen C. Crabb; Brian J. Crabb, both of Denver; Doug A. Worley; Dale G. Leidholm, both of Colorado Springs, all of Colo.

[73] Assignee: Nitebeam, Inc., Colorado Springs, Colo.

[21] Appl. No.: 08/699,583

[22] Filed: Aug. 19, 1996

Related U.S. Application Data

[63] Continuation-in-part of application No. 29/039,676, Jun. 1, 1995, Pat. No. Des. 384,789.

[51] Int. Cl.[6] ..... A42B 1/24

[52] U.S. Cl. ..... 2/209.13; 2/209.7; 2/906; 362/106

[58] Field of Search ..... 2/209.13, 906, 2/422, 181, 209.7; 362/106, 107

[56] References Cited

U.S. PATENT DOCUMENTS

| | | | |
|---|---|---|---|
| D. 176,073 | 11/1955 | Mantell | D3/13 |
| D. 264,391 | 5/1982 | Schweitzer | D2/230 |
| D. 309,523 | 7/1990 | Martin | D2/244 |
| D. 384,789 | 10/1997 | Crabb et al. | D2/866 |
| 870,350 | 11/1907 | Eliel . | |
| 1,109,415 | 9/1914 | Harris | 362/106 |
| 1,190,427 | 7/1916 | Kromer, Jr. . | |
| 1,540,345 | 6/1925 | Kowasik . | |
| 1,744,777 | 1/1930 | Lundgren . | |
| 2,131,617 | 9/1938 | Cowden | 2/3 |
| 2,473,394 | 6/1949 | Scott | 177/329 |
| 2,580,323 | 12/1951 | Russell | 2/176 |
| 2,744,256 | 5/1956 | Slotkin et al. | 2/209.13 |
| 3,128,474 | 4/1964 | Feldman | 2/195 |
| 3,254,444 | 6/1966 | Paterson . | |
| 4,312,076 | 1/1982 | Gamm | 2/199 |
| 4,386,437 | 6/1983 | Fosher | 2/199 |
| 4,406,040 | 9/1983 | Cannone | 24/3 J |
| 4,451,935 | 6/1984 | Henschel | 2/185 R |
| 4,718,126 | 1/1988 | Slay | 2/175 |
| 5,052,054 | 10/1991 | Birum | 2/10 |
| 5,053,932 | 10/1991 | Case | 362/105 |
| 5,117,510 | 6/1992 | Broussard et al. | 2/209 |
| 5,386,592 | 2/1995 | Checkeroski | 2/209.13 |

*Primary Examiner*—Diana L. Biefeld
*Attorney, Agent, or Firm*—Sheridan Ross P.C.

[57] ABSTRACT

A type of lightweight, multi-use headware is provided which has an aperture on one or both sides of the headware for temporarily receiving a small illuminating device in a non-obstructive manner that allows the handle of the illuminating device to be securely held within the interior of the headware. When the illuminating device is removed from the aperture the headware may be more traditionally used to shield the user's face and eyes from sunlight.

13 Claims, 9 Drawing Sheets

MULTI-USE CAP WITH ACCESSORIES POCKET

This invention is a Continuation-In-Part Application of U.S. patent application Ser. No. 29/039,676, filed on Jun. 1, 1995, now U.S. Pat. No. Des. 384,789.

FIELD OF THE INVENTION

The invention relates to headware, and particularly to a cap or hat which is constructed to temporarily hold a handle portion of an illuminating device in a concealed, non obstructive position, while permitting a head portion of the illuminating device to be exposed on the exterior of the hat for illumination. When the illuminating device is removed from the headware, the cap or hat may be used for its more traditional purpose of shielding the sun from the face of a user.

BACKGROUND OF THE INVENTION

The use of portable flashlights for illumination purposes are well known and frequently are used by hunters, fisherman, miners, fireman and others having a particular task to perform in the darkness. To permit the user of the flashlight to have both hands free to perform a designated task, it has been found advantageous to have the flashlight securely connected to headware worn by the user of the flashlight. This type of attachment allows the illuminating beam of light to be constantly positioned in the users direction of sight.

The headware used for the attachment of a flashlight has commonly been in the form of a rigid hardhat or helmet with an exterior bracket for attaching the flashlight, batteries to operate the flashlight or both. One type of configuration has a flashlight attached to the hardhat with a wire connected to a battery pack worn on the belt of the user. Another type of design has the batteries attached on the rear exterior surface of the hardhat. These types of configurations are generally heavy, cumbersome, and have a tendency to permit either the handle portion of the flashlight, the batteries attachment bracket, or wiring to become snagged or hooked on surrounding limbs from trees or shrubs or on other objects.

Another type of flashlight holder which may be worn around the users' head utilizes a headband or strap which attaches to a small flashlight. Although these apparatus are much lighter and less cumbersome to wear than the rigid hats described above, they do not adequately secure the flashlight to the user's head, and are additionally prone to objects such as limbs or twigs snagging the flashlight handle projecting from the strap. Furthermore, the headband type of flashlight holder does not have any other utility besides holding the flashlight. For example, the headband cannot be used to shield the sun from a user's eyes or provide protection in the case of a hard hat.

Thus, a need exists for a type of headware, and more particularly a cap or fedora to be constructed in a manner which allows a small flashlight handle to be temporarily and concealably secured to the hat in a manner which alleviates the flashlight handle from snagging other objects, yet is compatible for the user to wear for other uses such as shielding the sun.

SUMMARY OF THE INVENTION

It is thus one object of the present invention to provide a type of lightweights, non-rigid headware with means for attaching an illumination device in a manner which is non-obtrusive and not likely to snag on surrounding objects. It is a further object of the invention that the headware be capable of dual use during both nighttime and daytime conditions.

Thus, in one aspect of the present inventions a lightweight cap or fedora is constructed in a manner which allows the handle portion of a small flashlight to be concealably interconnected to the interior of the cap, while permitting a head portion of the flashlight to be exposed on an exterior portion of the cap for illumination purposes. The illumination device or flashlight is temporarily secured to the cap in a manner which permits the flashlight to be easily removed for other uses, and once removed, the cap is substantially indistinguishable from caps currently used by sportsmen, police officers and others who work or enjoy recreational activities in the dark.

Thus, it is an additional aspect of the invention that the cap be designed to appear substantially similar to commonly worn baseball type caps or fedora hats which may be used for its generally accepted purpose of shielding the users face from the sun during daylight. However, a nonobtrusive means for securing a flashlight within the cap is provided which is inexpensive to manufactures comfortable for the user and allows a traditional cap to be used for a dual purpose.

In another aspect of the invention the securement of the flashlight handle is accomplished in a manner which completely conceals the handle portion of the flashlight. This configuration is not only aesthetically pleasing but more importantly prevents the handle portion of the flashlight from being snagged or hooked by adjacent objects such as tree limbs and permits the cap and attached flashlight to be worn in confining spaces.

It is a further aspect of the invention that a small flashlight may be secured on either side of the hat or both sides if the user requires additional illumination. Thus, the invention allows a user to customize the use of the hat for whatever particular use is preferred.

To secure the flashlight to the headware, an expandable type fabric is generally interconnected to an interior surface of a side panel of the cap. The material forms a sleeve which is sized to specifically hold a small flashlight, and is generally stitched or glued to the cap for securement purposes. Furthermore, a strap or plurality of straps which utilize hook and loop type material or snaps may be used as opposed to a sleeve for securing the flashlight to the interior of the cape and again may be constructed of a flexible, expandable material.

To allow access of the flashlight handle to the interior of the cape an aperture, or opening is provided which extends through the side panel of the cap. Preferably, the aperture has a dimension which permits the handle portion of the flashlight to extend through the cap, yet is small enough to prevent a head portion of the flashlight from entering into the cap. Additionally, the aperture and sleeve within the interior of the cap may be positioned on a substantially parallel plane to the brim of the hat. Thus, when the hat is worn, the illuminating beam is directed along a plane in substantially the same direction as the orientation of the brim of the hat and the eyes of the user.

DETAILED DESCRIPTION OF THE PREFERRED EMBODIMENT

Figure 1:
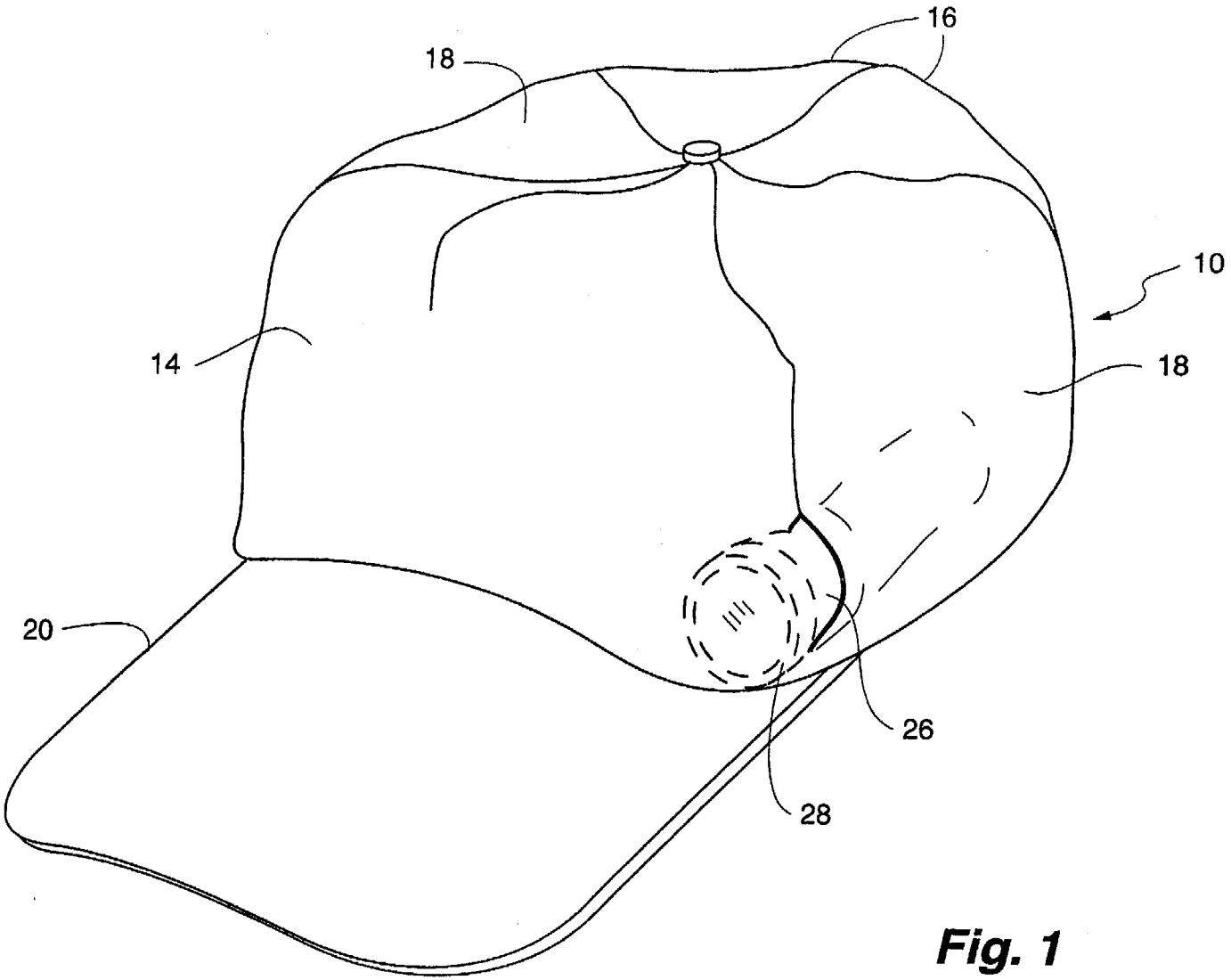
FIG. 1 is a top right perspective view of the present invention, with environment.
Figure 2:
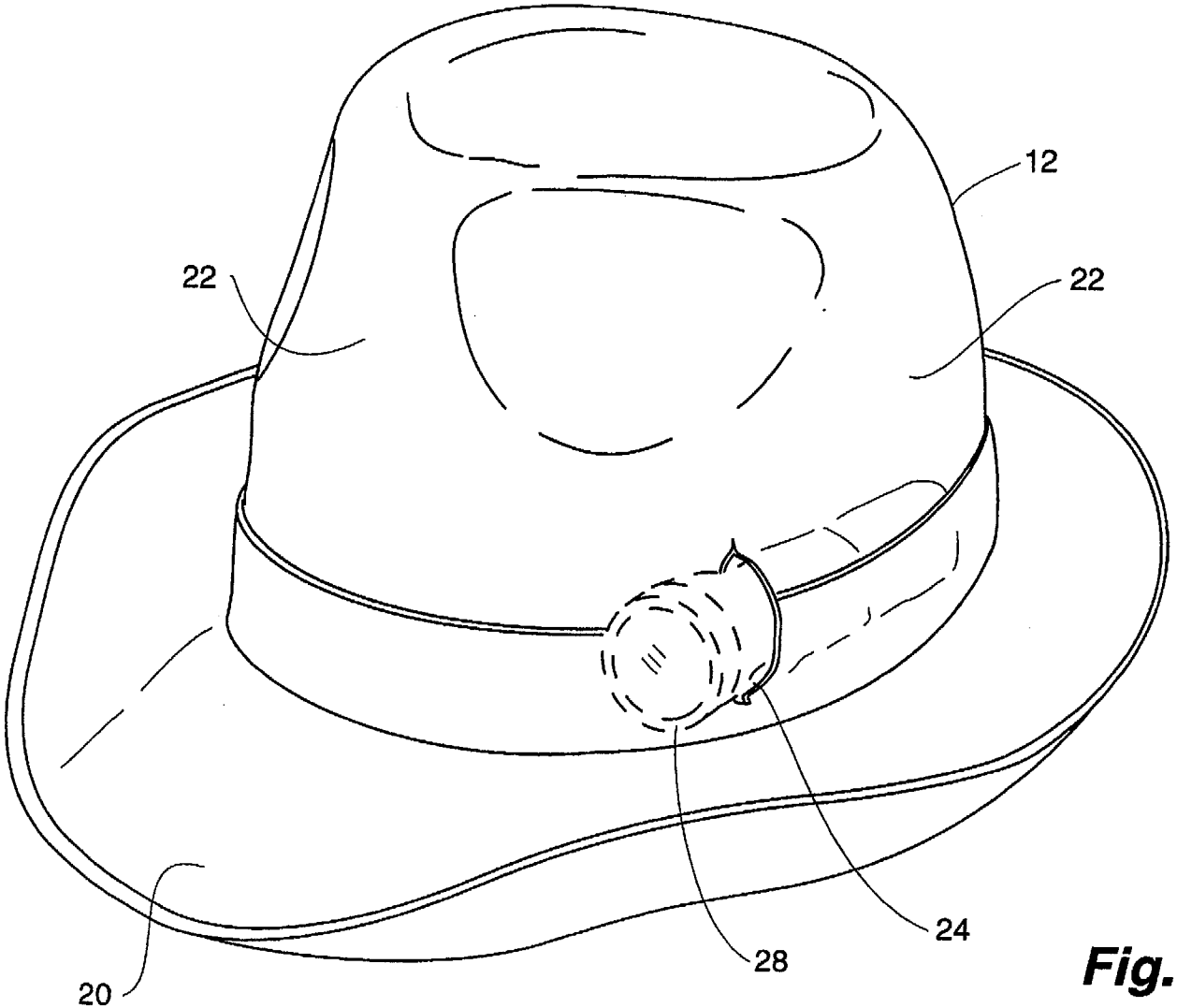
FIG. 2 is a top right perspective view of the present invention, with environment.
Figure 3:
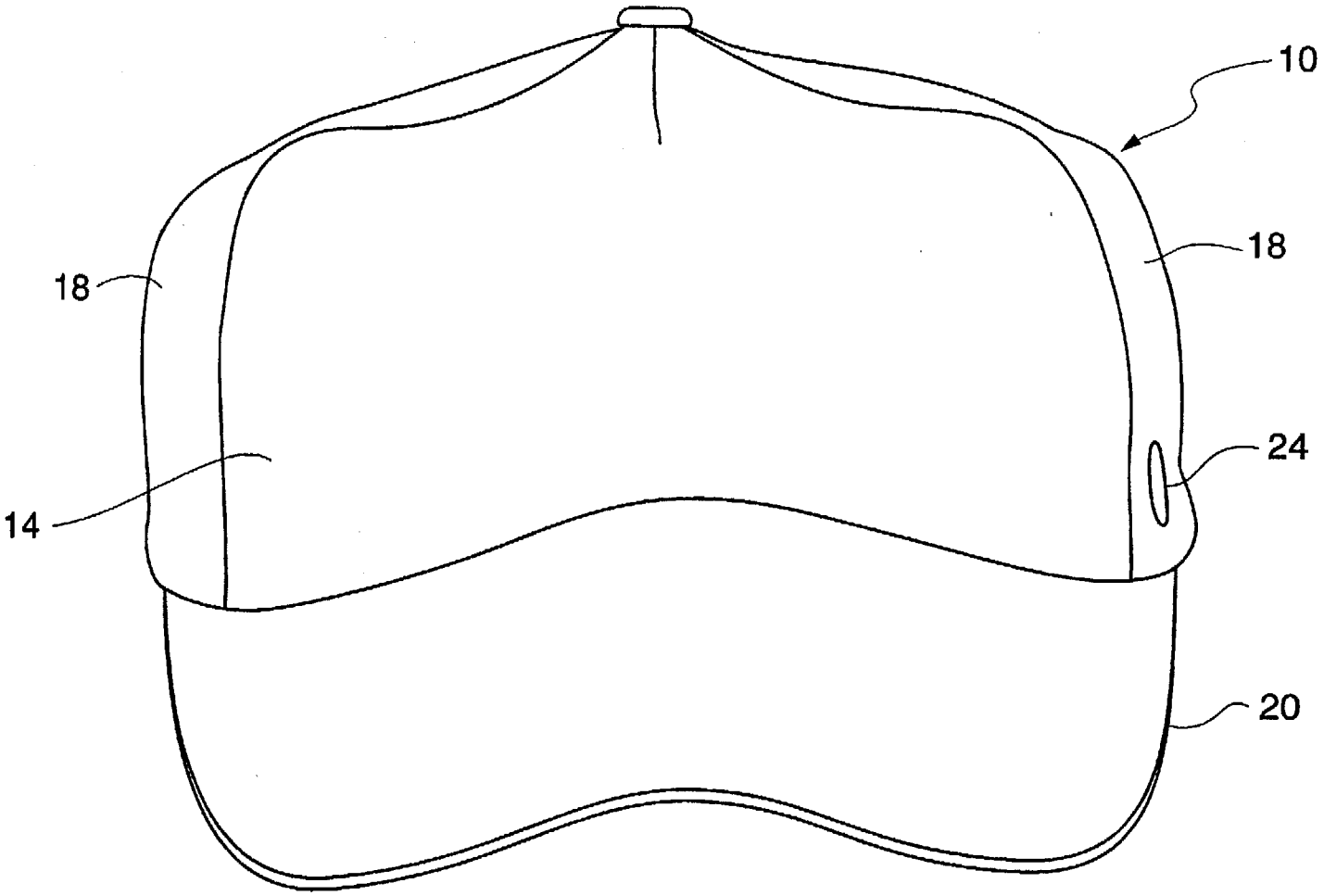
FIG. 3 is a front view of the present invention.
Figure 4:
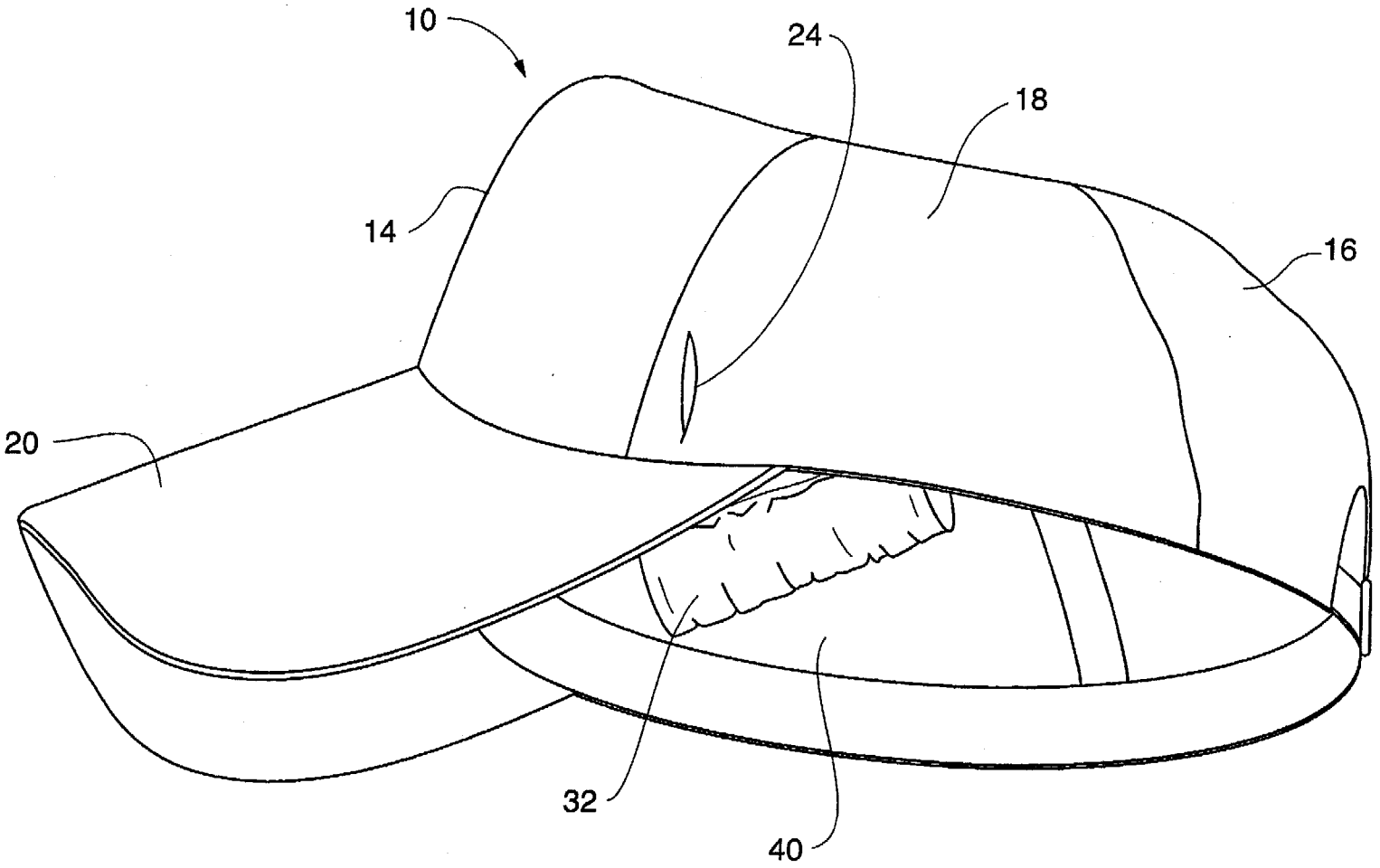
FIG. 4 is a left bottom perspective view of the present invention
Figure 5:
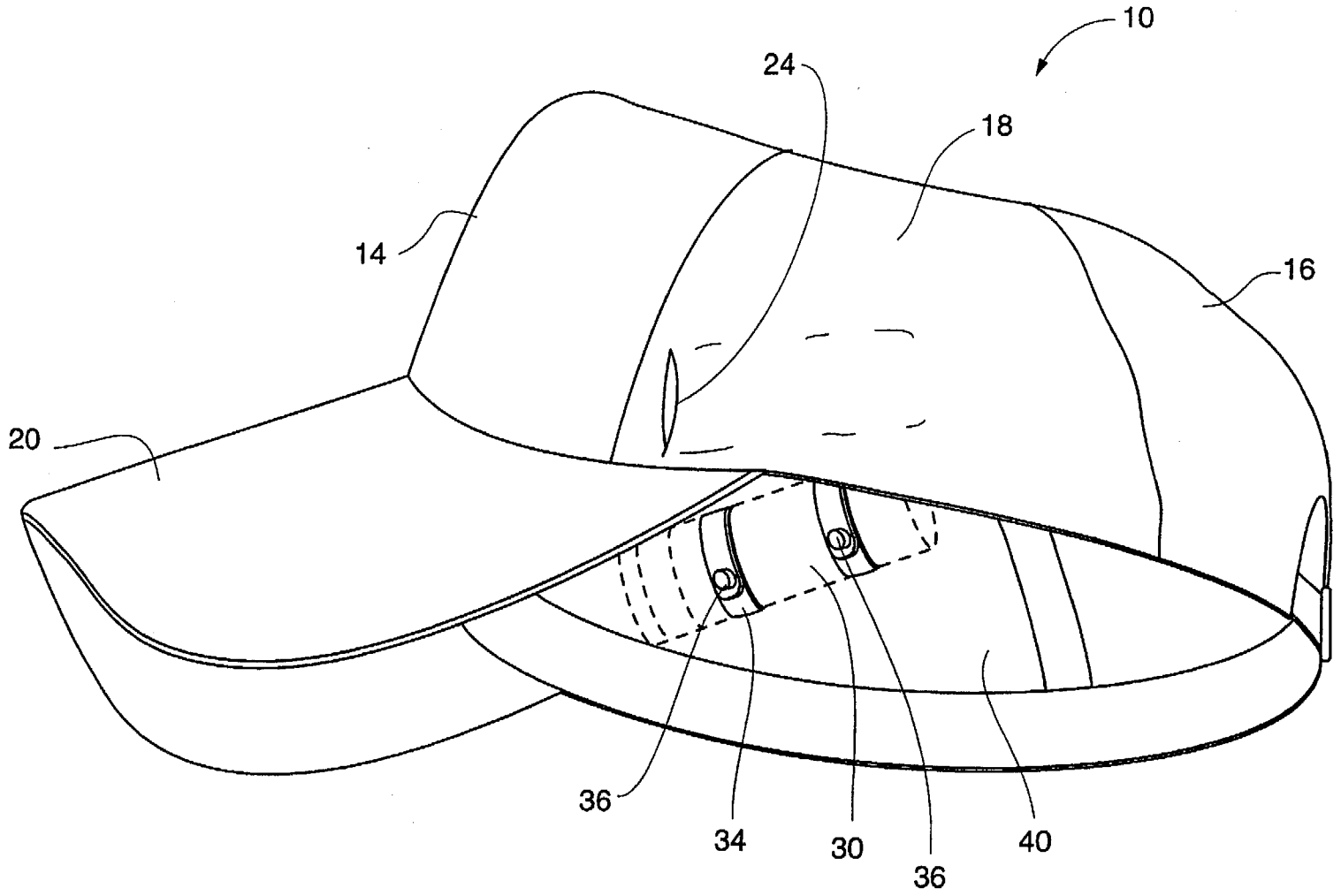
FIG. 5 is a left bottom perspective view showing an alternative embodiment of the present invention.
Figure 6:
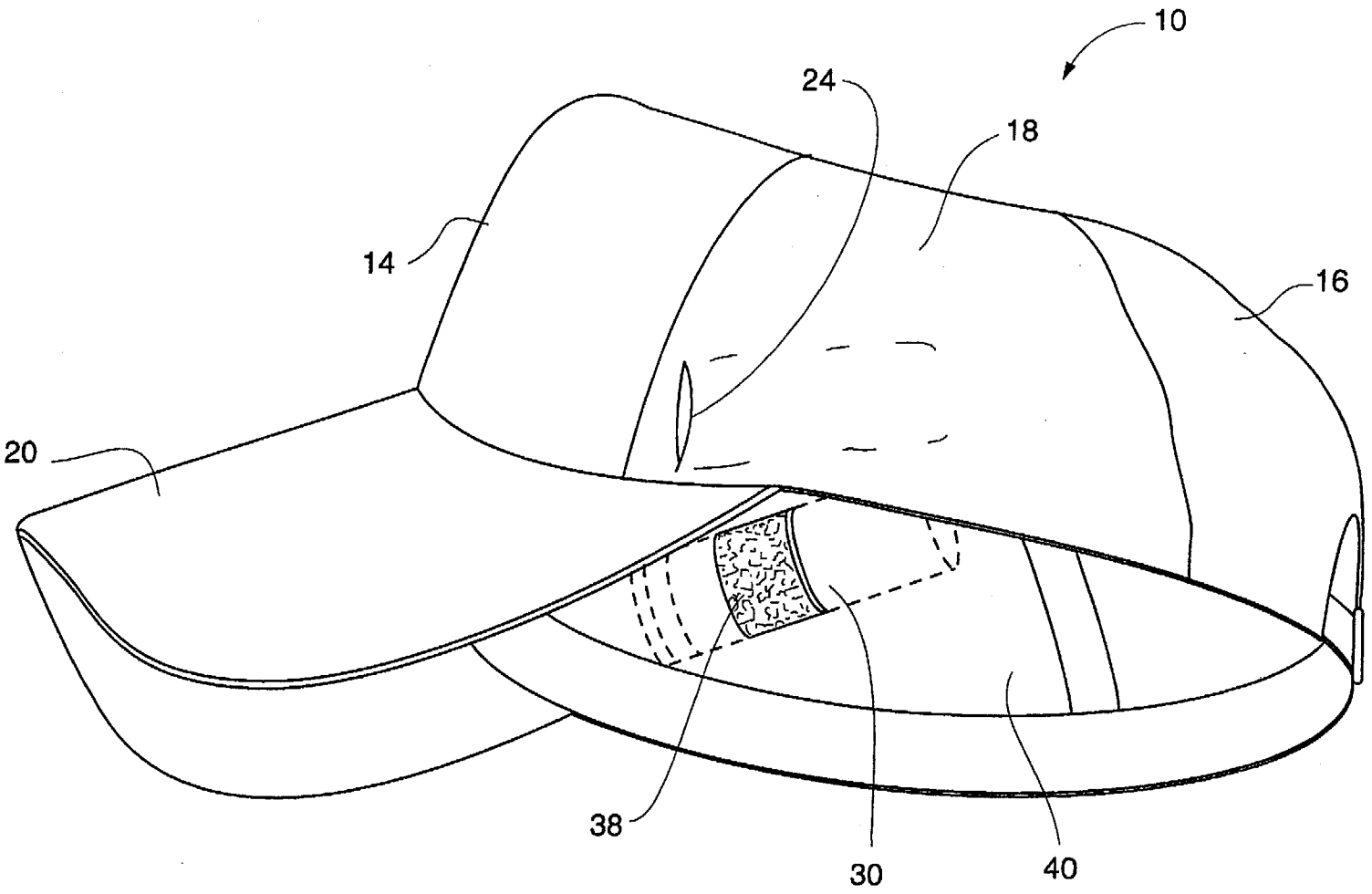
FIG. 6 is a left bottom perspective view showing an alternative embodiment of the present invention.
Figure 7:
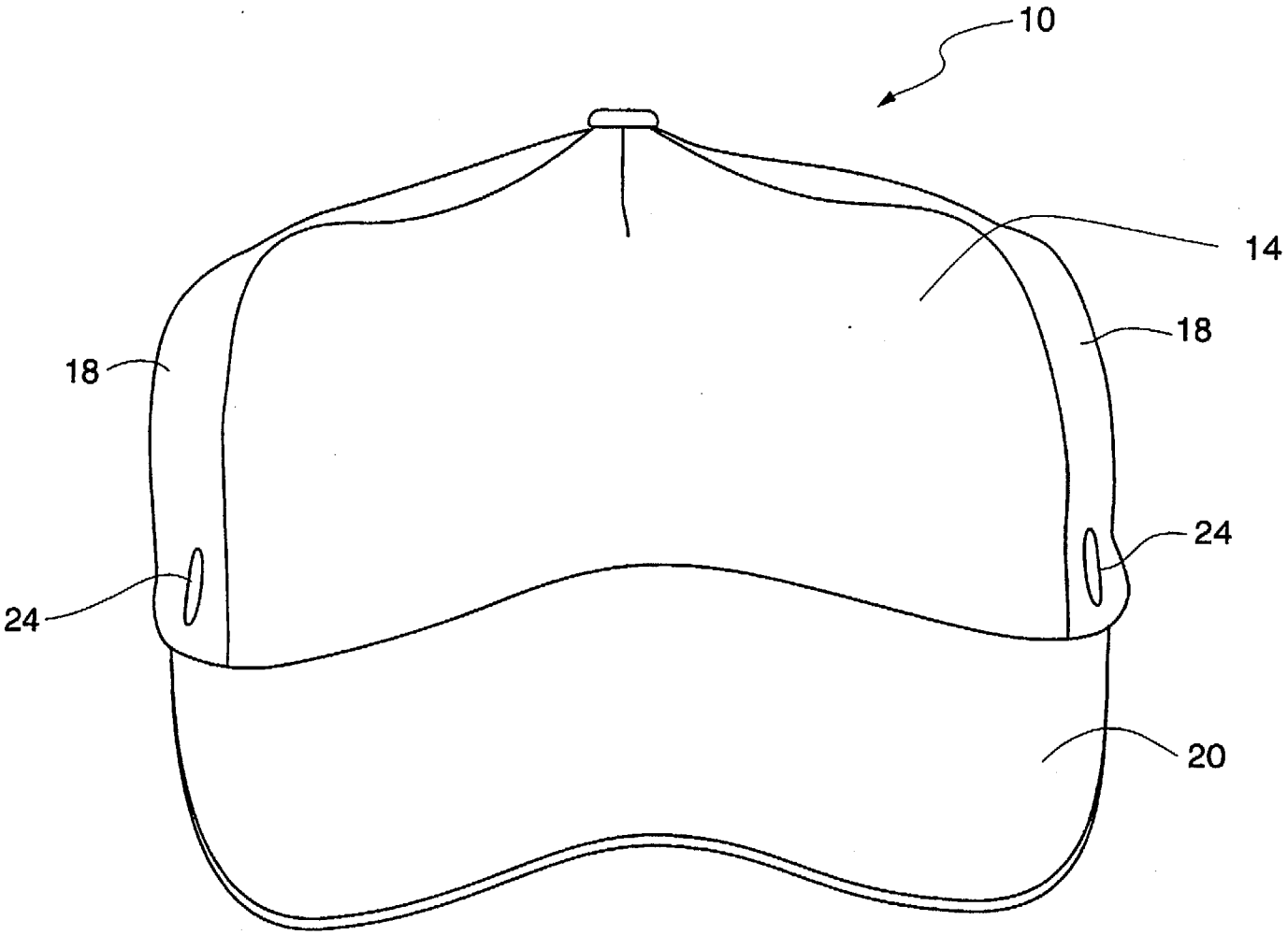
FIG. 7 is a front view showing an alternative embodiment of the invention shown in FIG. 1.
Figure 8:
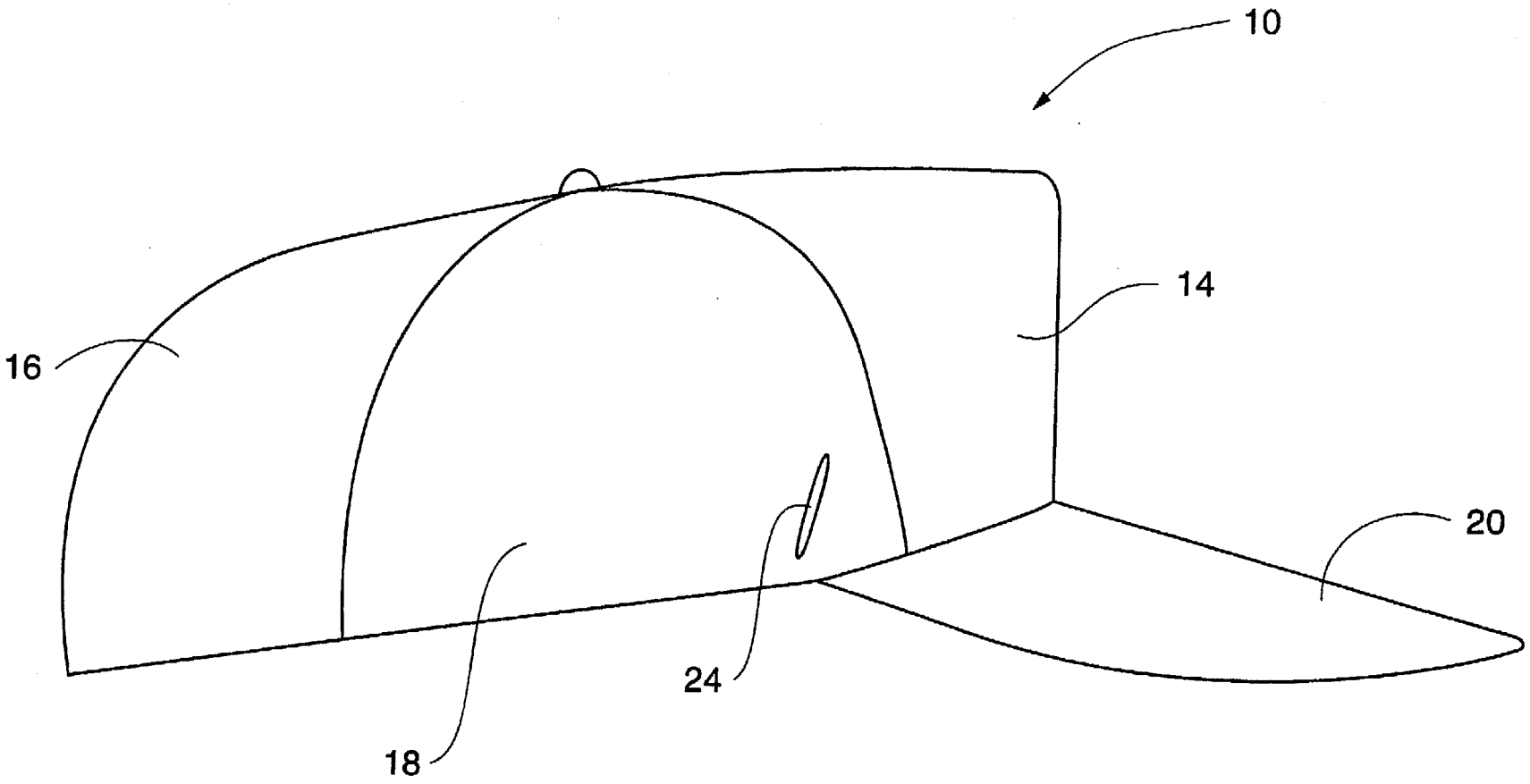
FIG. 8 is a left side view of an alternate embodiment of the invention shown in FIG. 1.
Figure 9:
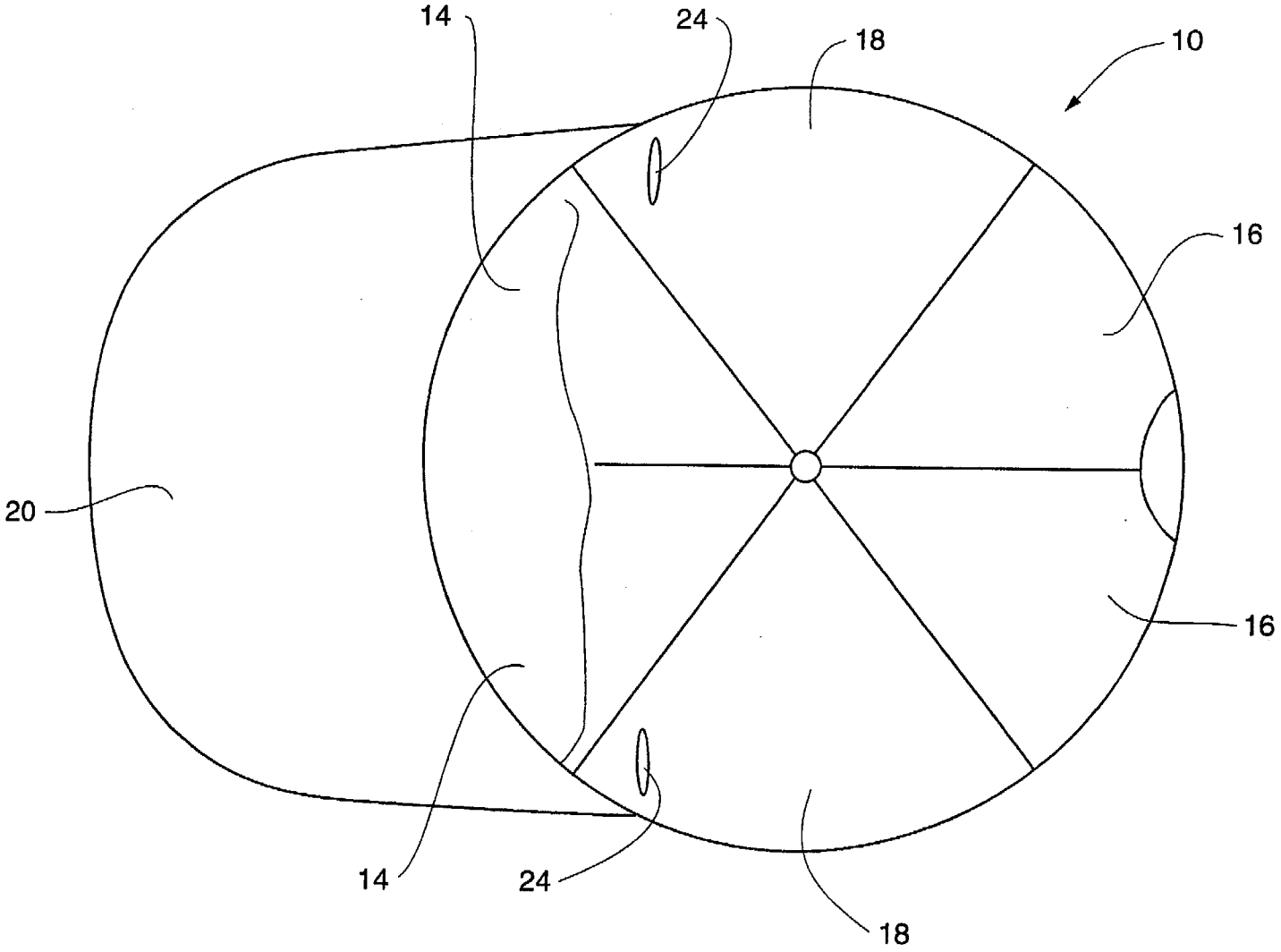
FIG. 9 is a top view of the invention shown in FIG. 7.

Referring now to FIGS. 1–6, an apparatus constructed in accordance with an embodiment of the present invention is generally identified by the reference number 10 or as an alternative embodiment as reference number 12. As shown, the apparatus generally comprises a front panel 14, back panel(s) 16, opposing side panels 18 and a brim 20. In a more traditional shaped hat 12 the apparatus comprises a crown 22 interconnected to a brim 20.

In either of the aforementioned embodiments an aperture 24 is located in either one or two side panels 18 or in one or two sides of the crown 22. The aperture 24 is generally an opening in the side panel(s) 18 of sufficient diameter to permit the entry of a flashlight handle 30 but small enough to prevent access of a flashlight head portion 28. Based on the design of the present invention the aperture 24 is positioned in such a manner that the flashlight handle 30 rests comfortably against the head of a user, but cannot be seen whatsoever from the exterior of the cap. When not in use, ie., holding a flashlight 26, the aperture is inconspicuous and barely visible to a casual observer. As a result either the cap 10 or hat 12 may be used during the daylight for its more traditional purpose of protecting the face and eyes of a user from the sun.

The aperture 24 in the cap 10 is interconnected to a means for securing the handle portion 30 to the interior surface 40 of the cap 10. In one embodiment of the present invention a sleeve 32 is provided to securely hold the flashlight handle 30 in place. The sleeve is generally constructed of a stretchable elastic type fabric which covers all or a portion of the flashlight handle 30. The sleeve 32 is generally interconnected to the interior surface 40 of the cap 10 by stitching or adhesives, although any other type of commonly known method for interconnecting fabrics could be utilized.

In an alternative embodiment the flashlight handle 30 may be interconnected with one or more attachment straps 34 which are held firmly around the flashlight handle with snaps 36. More preferably the strap(s) are comprised of a hook and loop type material 38 such as Velcro® to permit the flashlight handle 30 to be held firmly in place against the interior surface 40 of the hat 12 or cap 10.

To assure that the flashlight 26 illuminating beam is oriented in an optimal directions the aperture 24 and sleeve means for holding the flashlight handle 30 are oriented in substantially the same direction and plane as the brim 20 of the cap 10. Thus, the direction of light can be easily changed by changing the orientation of the hat 12 on the user's head.

The present invention has a number of advantages over other types of headware used to hold an illuminating device. First, the hat 12 or cap 10 is lightweight and can be used for both holding a flashlight 26 and its more typical purpose as a sunvisor to protect the wearer from the effects of bright sunshine. Thus, the user does not have to purchase two hats for two different purposes. Furthermore, by positioning the flashlight handle 30 inside the side panels 18 of the cap 10, as opposed on the outside, the flashlight handle 30 is less likely to get snagged by tree limbs or other obstructions commonly encountered by fisherman or other sportsman walking through a forest at night. Additionally, the aesthetic value the hat is enhanced since the only portion of the flashlight 26 which can be seen is the flashlight head portion 28.

While various embodiments of the present invention have been described in detail, it is apparent that further modifications and adaptations of the invention will occur to those skilled in the art. However, it is expressly understood that such modifications and adaptations are within the scope of the present invention. For clarity purposes, the following numbering of components is provided herein:

cap
hat
front panel
back panel
side panel
brim
crown
aperture
flashlight
flashlight head
flashlight handle
sleeve
attachment strap
snaps
hook and loop material
interior surface

What is claimed is:

1. A hat adapted for use in combination with a handheld flashlight to concealably hold a longitudinal handle portion of said handheld flashlight inside said hat, said hat having a front panel, a back panel, opposing side panels, and a brim, comprising:

an aperture in at least one of said side panels, said aperture having a sufficient dimension which is adapted to receive said longitudinal handle portion of said handheld flashlight; and a means for securing interconnected to an interior surface of at least one of said side panels of said hat, said means for securing adapted to receive at least a portion of said longitudinal handle portion of said flashlight in a concealed manner inside said hat, wherein said longitudinal handle portion of said handheld flashlight may be positioned substantially entirely inside said hat and a head portion of said handheld flashlight may be located outside said hat.

2. The hat of claim 1, wherein said means for securing comprises an expandable sleeve.

3. The hat of claim 2, wherein said sleeve is comprised of an expandable material.

4. The hat of claim 2, wherein said means for securing is interconnected to said interior surface of at least one of said side panels by stitching.

5. The hat of claim 1, wherein said means for securing comprises at least one strap interconnected to said interior surface of said at least one of said side panels, said strap being to receive said handle portion of said flashlight.

6. The hat of claim 5, wherein said strap is comprised of an expandable material sewn to said interior surface of said at least one of said side panels.

7. The hat of claim 1, wherein said means for securing inside said hat is aligned on substantially the same plane as said brim of said hat, wherein a light from said head of said handheld flashlight may be directed in a plane which is substantially parallel to said brim of said hat.

8. The hat of claim 1, wherein said aperture is substantially concealed from view from an exterior of said hat when said handheld flashlight is not inserted in said aperture.

9. The hat of claim 1, wherein said means for securing comprises one component of a hook and loop type material which is interconnected to said interior surface of at least one of said side panels and adapted to interconnect to an opposing component of said hook and loop type material on said handle portion of said flashlight.

10. The hat of claim 1, wherein said means for securing comprises at least one strap interconnected to said interior surface of said at least one of said side panels, said strap being adapted to wrap substantially around said handle portion of said handheld flashlight.

11. The hat of claim 1, wherein said means for securing comprises one component of a hoop and loop type material which is interconnected to said interior surface of said at least one of said side panels and an opposing component of said hook and loop type material which is adapted to interconnect to said handle portion of said handheld flashlight.

12. A hat adapted for use in combination with a handheld illuminating device to concealably hold a longitudinal handle portion of said illuminating device substantially inside said hat, said hat comprising a crown substantially surrounding a user's head and a brim interconnected to said crown, comprising:

an aperture positioned in a forward portion of said crown, said aperture having a sufficient dimension which is adapted to receive said longitudinal handle portion of said handheld illuminating device;

an expandable sleeve interconnected to an interior surface of said crown of said hat, said expandable sleeve adapted to receive at least a portion of said longitudinal handle portion of said illuminating device inside said cap, wherein a head portion of said handheld illuminating device may be located on the exterior of said cap.

13. A cap adapted for use in combination with a handheld flashlight, said cap having a front panel, a back panel, a pair of opposing side panels, and a brim, comprising:

an aperture positioned in one of said side panels, said aperture having a sufficient dimension which is adapted to receive a tubular longitudinal handle portion of said handheld flashlight, yet small enough to prevent passage of a head portion of said handheld flashlight within said aperture; and a sleeve having a top edge, bottom edge, front end and a back end, said top edge and said bottom edge being interconnected to an interior surface of said side panel of said cap and said front edge being aligned with said aperture of said cap, said aperture sized and adapted for receiving said tubular longitudinal handle portion of said handheld flashlight, wherein when said tubular longitudinal handle portion of said handle flashlight may be inserted into said sleeve, said tubular longitudinal handle portion may be secured to said cap and substantially concealed from view by said side panel, yet a head portion of said handheld flashlight may be exposed outside of said cap for illumination.

* * * * *